US005807198A

United States Patent [19]

Grimm

[11] Patent Number: 5,807,198

[45] Date of Patent: Sep. 15, 1998

[54] TOSSABLE GAME-BALL DEVICE

[75] Inventor: Thomas H. Grimm, Menlo Park, Calif.

[73] Assignee: OddzOn Products, Inc., Campbell, Calif.

[21] Appl. No.: 807,644

[22] Filed: Feb. 27, 1997

[51] Int. Cl.[6] ..... A63B 43/00

[52] U.S. Cl. ..... 473/613

[58] Field of Search ..... 473/596, 599, 473/600, 601, 602, 603, 613, 586; D21/204

[56] References Cited

U.S. PATENT DOCUMENTS

| | | | |
|---|---|---|---|
| 23,538 | 4/1859 | Arnold . | |
| Re. 33,449 | 11/1990 | Martin . | |
| D. 92,721 | 7/1934 | Jary . | |
| D. 235,794 | 7/1975 | Kroener . | |
| D. 288,216 | 2/1987 | Jensen . | |
| D. 306,894 | 3/1990 | DeMarco . | |
| D. 322,105 | 12/1991 | Ma . | |
| D. 335,906 | 5/1993 | Hellerman . | |
| D. 346,001 | 4/1994 | Stillinger et al. | D21/204 |
| D. 348,907 | 7/1994 | Prentice et al. . | |
| D. 350,577 | 9/1994 | Giudice . | |
| D. 353,427 | 12/1994 | Wuesthoff . | |
| D. 355,460 | 2/1995 | Routzong et al. . | |
| D. 361,811 | 8/1995 | Grimm et al. | D21/204 |
| 1,293,869 | 2/1919 | Murray et al. . | |
| 1,296,403 | 3/1919 | Kindle . | |
| 1,520,131 | 12/1924 | Jacob . | |
| 1,718,508 | 6/1929 | White . | |
| 2,183,152 | 12/1939 | Prensky et al. . | |
| 2,338,719 | 1/1944 | Holt . | |
| 2,432,209 | 12/1947 | Osgood . | |
| 2,494,026 | 1/1950 | Anderson . | |
| 2,608,027 | 8/1952 | Perker et al. . | |
| 2,611,999 | 9/1952 | Mikolay . | |
| 2,759,297 | 8/1956 | Lewis . | |
| 2,763,958 | 9/1956 | Lemelson . | |
| 2,870,570 | 1/1959 | Benson . | |
| 3,147,011 | 9/1964 | Lemelson . | |
| 3,190,654 | 6/1965 | Ross . | |
| 3,198,526 | 8/1965 | Smith et al. . | |
| 3,225,488 | 12/1965 | Goldfarb . | |
| 3,256,020 | 6/1966 | Smith . | |
| 3,292,879 | 12/1966 | Chilowsky . | |
| 3,373,730 | 3/1968 | Jenison . | |
| 3,437,340 | 4/1969 | Grise . | |
| 3,528,662 | 9/1970 | Merchant et al. . | |
| 3,746,334 | 7/1973 | Stubblefield . | |
| 3,909,976 | 10/1975 | Kirk . | |
| 4,021,041 | 5/1977 | Goldfarb et al. . | |
| 4,088,319 | 5/1978 | Clarke . | |
| 4,109,411 | 8/1978 | Wetherell et al. . | |

(List continued on next page.)

FOREIGN PATENT DOCUMENTS

| | | |
|---|---|---|
| 81 12961 | 7/1981 | France . |
| 900310 | 7/1949 | Germany . |
| 60-242870 | 12/1985 | Japan . |
| 469863 | 9/1937 | United Kingdom . |

OTHER PUBLICATIONS

Barr Rubber Products Co., 1965 Athletic Ball Catalog, Mar. 10, 1965.

Parker Brothers Catalog, 1988.

Parker Brothers Catalog, 1991.

OddzOn Products, Inc., "Koosh Super Grip Football", 1996.

*Primary Examiner*—Steven B. Wong

*Attorney, Agent, or Firm*—Kolisch, Hartwell, Dickinson, McCormack & Heuser

[57] ABSTRACT

A multi-component game ball comprising (1) a generally football-shaped inner core formed of a high-resilience, polyurethane foam, (2) a generally football-shaped outer core encasing and bound to the inner core formed preferably of a soft, slow-return, polyurethane foam, (3) a thin, generally football-shaped, high-friction, grip-enhancing outer skin encasing and bound to the outer core formed preferably of a water-based, pigmented, acrylic emulsion, barrier release coating for urethane foam, and (4) a flight-enhancing, elongate tail structure extending from within the assembly (made up of the inner and outer cores and the skin) and extending outwardly along the ball's long axis, with radially extending fin structure forming part thereof.

5 Claims, 2 Drawing Sheets

U.S. PATENT DOCUMENTS

| | | | |
|---|---|---|---|
| 4,112,613 | 9/1978 | Toplak . | |
| 4,256,304 | 3/1981 | Smith et al. . | |
| 4,262,911 | 4/1981 | Opresik et al. . | |
| 4,294,447 | 10/1981 | Clark . | |
| 4,335,537 | 6/1982 | Walker . | |
| 4,339,138 | 7/1982 | Di Manno . | |
| 4,366,936 | 1/1983 | Ferguson . | |
| 4,438,924 | 3/1984 | Carr . | |
| 4,463,951 | 8/1984 | Kumaska et al. . | |
| 4,531,737 | 7/1985 | Jacobson et al. . | |
| 4,537,405 | 8/1985 | Cymbler . | |
| 4,598,909 | 7/1986 | Ventura et al. . | |
| 4,641,839 | 2/1987 | Turner . | |
| 4,657,253 | 4/1987 | Lerner et al. . | |
| 4,660,830 | 4/1987 | Tomar . | |
| 4,736,948 | 4/1988 | Thomas . | |
| 4,763,900 | 8/1988 | Carr . | |
| 4,772,020 | 9/1988 | Martin . | |
| 4,887,814 | 12/1989 | Winter . | |
| 4,919,422 | 4/1990 | Ma . | |
| 4,930,777 | 6/1990 | Holenstein . | |
| 4,943,066 | 7/1990 | Lathim et al. . | |
| 4,944,363 | 7/1990 | Osher et al. | 473/601 |
| 5,020,438 | 6/1991 | Brown . | |
| 5,045,011 | 9/1991 | Lovik . | |
| 5,066,017 | 11/1991 | Kurland . | |
| 5,133,550 | 7/1992 | Handy . | |
| 5,228,690 | 7/1993 | Rudell et al. . | |
| 5,267,735 | 12/1993 | Bushman . | |
| 5,269,514 | 12/1993 | Adler et al. . | |
| 5,284,341 | 2/1994 | Routzong et al. | 473/613 |
| 5,514,023 | 5/1996 | Warner | 473/613 |

TOSSABLE GAME-BALL DEVICE

BACKGROUND AND SUMMARY OF THE INVENTION

This invention relates to a tossable game-ball device, and in particular to such a device which includes a generally football-shaped ball component, from one end of which extends an elongate tail having radial fins.

An important object of the invention is to offer a device of the type just generally described which has enhanced handling and flying qualifies, and which, particularly when played with by youngsters, suprisingly promotes the throwing of better and longer-distance throws.

Another object is to provide such a device wherein the football-shaped ball component has a soft, spongy, collapse-energy-absorbing, outer core layer and which enables easy catching.

According to a preferred embodiment of the invention, now about to be described in more detail, the device of the invention includes a generally football-shaped end component which is formed with a molded inner core of high-resilience, polyurethane foam, an outer core which jackets the inner core formed of molded, slowreturn, very spongy, polyurethane foam, and an outer, high-friction, grip-enhancing skin formed of a thin layer (typically about 2-mils) of a water-based, pigmented, acrylic emulsion, barrier release coating for urethane foam. Extending longitudinally from the football-shaped component is an elongate, "flight-stabilizing" tail structure, the end of which that is distant from the football-shaped component carrying radially outwardly extending fins.

The tail structure includes a specially designed stiffener and stiffener cap structure which both enhance flight performance and remain securely anchored in place relative to the football-shaped component—the latter being an important safety consideration.

These and other objects, advantages and features which are offered by the present invention will become more fully apparent as the description that now follows is read in conjunction with the accompanying drawings.

DETAILED DESCRIPTION OF THE INVENTION

Figures 1, 2:
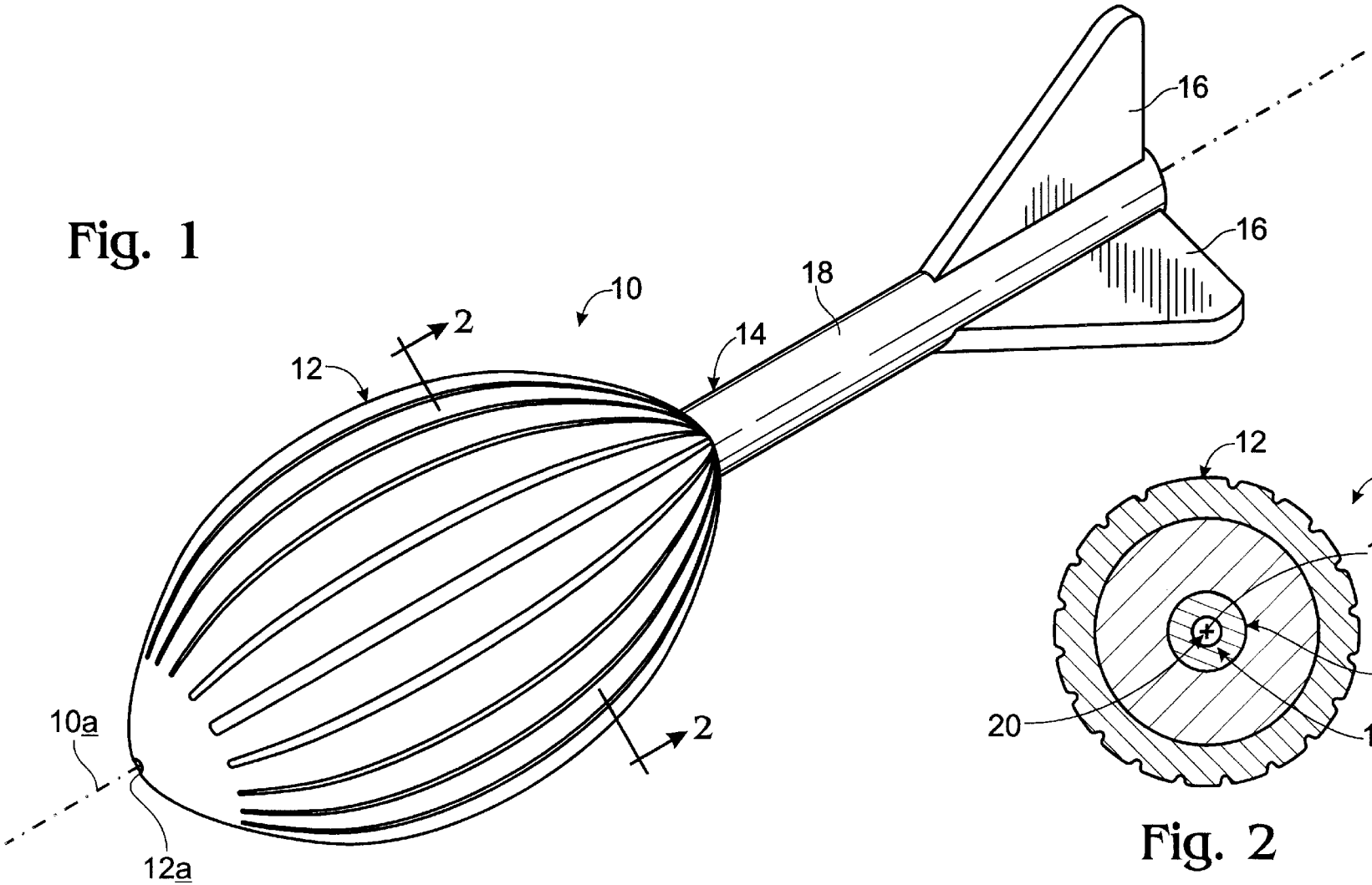
FIG. 1 is a perspective view illustrating a device, referred to hereinafter as a ball, constructed in accordance with the present invention.
FIG. 2 is a cross-sectional view taken generally along the line 2—2 in FIG. 1.
Figure 4:
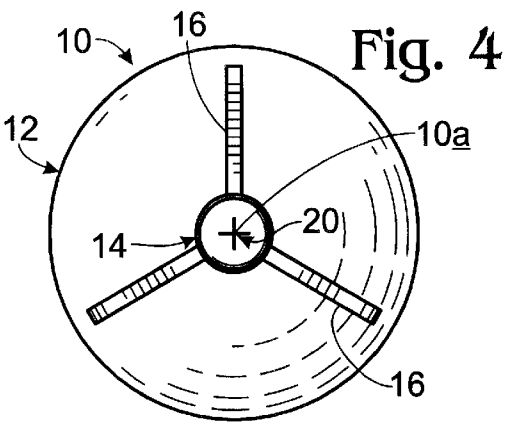
FIG. 4 is an end view taken generally along the line 4—4 in FIG. 3.
Figure 3:
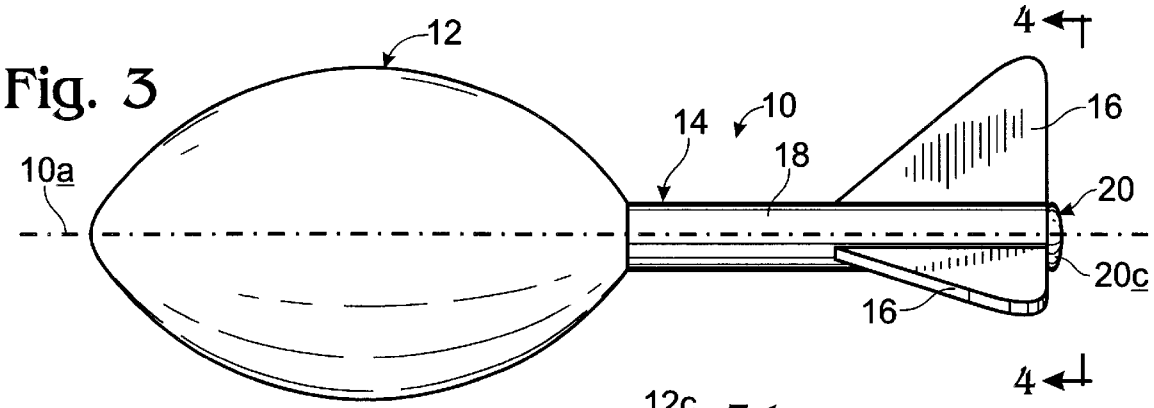
FIG. 3 a reduced-scale side elevation of the ball of FIG. 1, with external, elongate grooving that is formed on the outside of the football-shaped portion of the ball omitted from this view.

Turning attention now to the drawings, and referring, initially, to FIGS. 1–5, inclusive, indicated generally at 10 is a ball constructed in accordance with the present invention. In general terms, ball 10 includes an elongate, surface-grooved, football-shaped component, unit, or assembly, 12, and an elongate tail structure 14 which extends from one end of assembly 12 generally centered on and along the long axis 10*a* of the ball. The tail structure includes three, radially extending, equally angularly displaced, generally triangular, die-cut, cross-linked, polyethylene fins 16 which are suitably bonded to an elongate, extruded, polyethylene, tubular spine 18 which is carried on and bonded to a major portion of an elongate, polypropylene, molded stiffener 20, the details of which will be more fully described shortly. The three fins are also referred to herein as fin structure. In FIG. 2, cross-hatching lines have been omitted from the cross-sectional view of stiffener 20 in order to avoid unnecessarily cluttering the center of that view.

Assembly 12 is made up of three components, including a dense, molded, generally football-shaped, inner core 12*a* which is formed of a high-resilience, polyurethane foam, a generally football-shaped outer core 12*b* which has been molded to encase inner core 12*a*, with this outer core being formed preferably of a soft, spongy, slow-return, polyurethane foam, and a thin outer skin 12*c* which is formed preferably of a high-friction, grip-enhancing material—preferably a water-based, pigmented, acrylic emulsion, barrier release coating for urethane foam.

This interesting and special, sandwich-like combination of elements produces a ball-like unit which has marvelous throwing, energy-absorbing catching, and other handling, qualities. The dense central core furnishes definitive mass and shape stability to the unit. The softer outer core furnishes a certain important amount of squeezability which makes gripping for throwing, as well as catching, quite pleasing and easy. The high-frictioning thin skin offers sureness of grip/purchase in handling the unit.

The process for creating and joining together all of the components that make up ball 10 will be described shortly, after remaining structural details are described.

Figure 5:
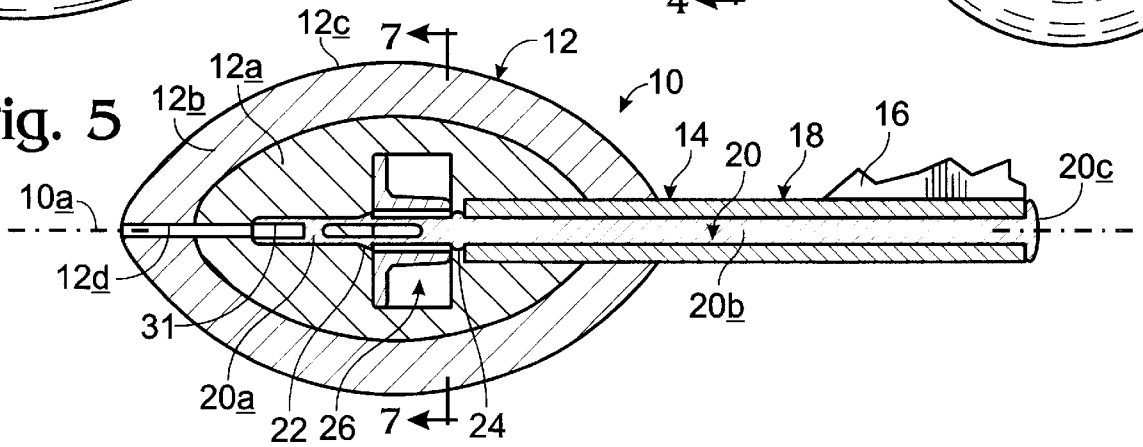
FIG. 5 is a longitudinal cross section of the ball, with fin structure shown only partially and fragmentarily.
Figure 6:
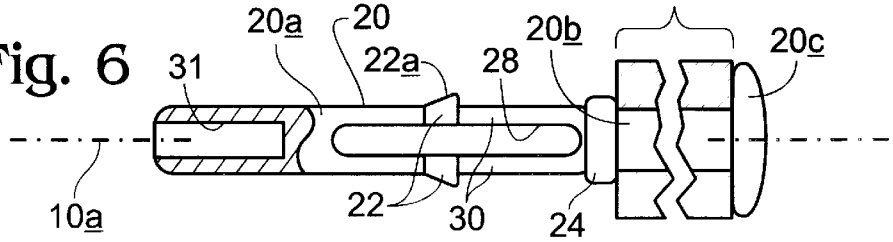
FIG. 6 is a fragmentary view, on a larger scale than that employed in FIG. 5, illustrating, principally, details of the left end in FIG. 5 of a stiffener which is employed in the tail structure of the ball.
Figure 7:
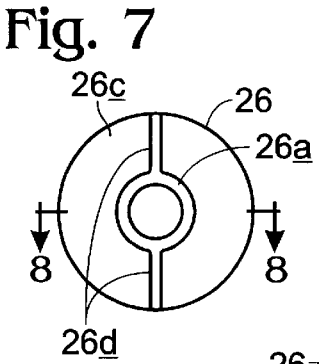
FIG. 7 is a view on about the same scale employed in FIG. 6 illustrating (removed from other structure) a stiffener cap which forms part of the ball of the invention, with this cap being viewed generally from the point of view indicated by the line 7—7 in FIG. 5.
Figure 8:
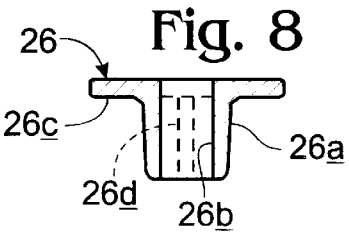
FIG. 8 is a cross-sectional view taken generally along the line 8—8 in FIG. 7.

Accordingly, and continuing now with a structural description, and referring to FIGS. 6–8, inclusive, along with FIGS. 1–5, inclusive, stiffener 20 includes what is referred to herein as "one" elongate stretch 20*a* which is located toward the left end of the stiffener in FIG. 5 and 6, joining with a much longer, "other" elongate stretch 20*b*. that extends from within assembly 12 outwardly to the right of the assembly in FIGS. 5 and 6 along axis 10*a*.

Stretch 20*a*, which is also referred to herein as a finger portion, includes a pair of axially spaced shoulder units 22, 24 (see particularly FIGS. 5 and 6) which are designed to capture (against axial escape) a molded stiffener cap 26. Cap 26 is shown captured and in place in FIG. 5, is omitted from FIG. 6, and is shown in an isolated/separated condition in FIGS. 7 and 8. Shoulder units 22, 24 are referred to herein collectively as shoulder structure.

Formed in finger portion 20*a* is an elongate through-slot 28 which extends in reaches that are disposed on opposite sides (as can be seen) of shoulder unit 22, thus to define a pair of elongate, spaced, opposed, elastically deformable (squeezable-together) runs 30. Shoulder unit 22 includes what is referred to herein as a beveled cam surface 22*a* which faces away from shoulder unit 24. This construction allows easy slip-fitting, as will be explained, of cap 26 onto stiffener 20.

Finger portion 20*a* also includes an exposed, elongate, slightly tapered, end bore 31 which is longitudinally aligned with axis 10*a*. Bore 31 communicates with a bore 12*d* which is used in relation to display packaging of ball 10 in accordance with the teachings of my copending U.S. Pat. application Ser. No. 08/807,622 for ARTICLE PACKAGING, filed Feb. 27, 1997, hereby incorporated herein by reference.

Formed on the right end of stretch 20*b* is an end-defining button 20*c*.

Completing now a structural description of what is shown in the drawings, and focusing attention particularly on FIGS. 5, 7 and 8, stiffener cap 26 includes an elongate central stem 26*a* having an elongate central aperture 26*b* adjacent one end of which there is formed an outwardly radially extending annular flange 26*c* which is reinforced, with respect to the stem, by a pair of diametrically opposed stiffening webs 26*d*.

Stiffener 20 and stiffener cap 26, also form part of tail structure 14.

Considering now the procedure for making ball 10, fins 16 are appropriately bonded to spine 18, and the spine is then slipped onto and slid along the stiffener in a direction toward button 20*c* until it abuts the button and occupies the region between this button and shoulder unit 24 (as shown). A suitable adhesive is used in the interface between these parts to bind them together.

The stiffener and stiffener cap are slip-fit together, with the exposed end of finger portion 20*a* inserted into that end of aperture 26*b* which is away from flange 26*c*. This action results in a canning activity involving shoulder unit 22, which activity results in squeezing together of runs 30 to allow shoulder unit 22 to pass through the aperture and then to snap back into its relaxed-state condition with the stiffener cap locked in place against axial movement between the two shoulder units. The assembled tail structure with an elongate, slender filament (not shown) extending axially outwardly from within bore 31, is then insert-molded in a suitable fashion to become lodged within molded inner core 12*a*. Thereafter, the partial assembly, now including the tail structure, the still outwardly extending filament just mentioned, and the inner core, is suitably disposed within a mold cavity designed to form outer core 12*b*, with the wall surface of this cavity having been appropriately pretreated with the outer skin-forming material. In the situation now being described, this outer skin material is a water-based, pigmented, acrylic emulsion, barrier release coating for urethane foam material made available by Akzo Nobel Coatings, Inc. of Somerset, N.J. A suitable, independent mold-release agent is employed in the interface between this skin material and the mold just mentioned. Molding of the outer core then takes place, the full assembly is freed from the mold, and the elongate filament is pulled free to leave bore 12*d*. This completes construction of the ball.

As was mentioned earlier, the outside topography of the overall football-like assembly is longitudinally grooved, as is pictured in FIGS. 1 and 2.

The ball of this invention has been found to live-up handily to the expectations of offering a tossable ball-like device which is capable of extremely and suprisingly long flights when thrown. For example, thrown flights exceeding a 100-yards have been achieved. The ball in flight is quite stable against wobbling. Additionally, the ball is very easy to catch because, principally, of the soft, energy-absorbing, outer core 12*b*.

Accordingly, while a preferred embodiment of this invention, and a method of making it, have been illustrated and described herein, it is appreciated that variations and modifications with respect thereto may be made without departing from the spirit of the invention.

It is claimed and desired to secure by Letters Patent:

1. A multi-component game ball having a long axis and comprising a generally football-shaped inner core unit formed of a high-resilience, polyurethane foam, a generally football-shaped, outer core unit encasing and bound to said inner core unit, formed of a soft, slow-return polyurethane foam, a thin, generally football-shaped, high-friction, grip-enhancing, outer skin encasing and bound to said outer core unit, formed of a water-based, pigmented, acrylic emulsion, barrier release coating for urethane foam, said core units and said skin collectively forming an assembly, and a flight-enhancing, elongate tail structure extending from within said assembly along the ball's said long axis and projecting outwardly axially from one end of that assembly, said tail structure including, adjacent an end which is spaced from the assembly, radially outwardly extending fin structure.

2. The ball of claim 1, wherein said tail structure includes an elongate stiffener having one stretch disposed within in said assembly and another stretch extending outwardly from the assembly, a stiffener cap resident within the assembly captured on and generally encircling said one stretch and including a radially disposed flange captured within said inner core unit, and a tubular, sleeve-like spine circumsurrounding and jacketing said other stretch generally along the entire length thereof.

3. The ball of claim 2, wherein said spine is bonded to said other stretch.

4. The ball of claim 2, wherein (1) said stiffener cap possesses an elongate central aperature, (2) said one stretch takes the form of an elongate finger portion which has been slip-fit through said aperature, and (3) shoulder structure including longitudinally spaced shoulder units is formed on said finger structure, which units rest against and axially capture opposite axial sides of said cap.

5. The ball of claim 4, wherein said finger portion includes an elongate through-slot extending longitudinally in the finger portion in reaches disposed on opposite sides of one of said shoulder units and defining a pair of elongate, spaced, opposed, elastically deformable (squeezable-together) runs, and said one shoulder unit includes a beveled cam surface which faces away from the other shoulder unit and which is interactively engageable with one end of said aperture during the process of slip-fitting said cap onto said finger portion into a condition captured by and between said shoulder units.

* * * * *